US011208281B2

(12) United States Patent
Paré et al.

(10) Patent No.: US 11,208,281 B2
(45) Date of Patent: Dec. 28, 2021

(54) WEB MATERIAL DISPENSER

(71) Applicant: CASCADES CANADA ULC, Kingsey Falls (CA)

(72) Inventors: Richard Paré, Boucherville (CA); Antoine Dallaire, Montreal (CA); Mélody Sue Myette, Montréal (CA)

(73) Assignee: CASCADES CANADA ULC, Kingsey Falls (CA)

( * ) Notice: Subject to any disclaimer, the term of this patent is extended or adjusted under 35 U.S.C. 154(b) by 63 days.

(21) Appl. No.: 16/659,247

(22) Filed: Oct. 21, 2019

(65) Prior Publication Data

US 2020/0122946 A1 Apr. 23, 2020

Related U.S. Application Data

(60) Provisional application No. 62/748,718, filed on Oct. 22, 2018.

(51) Int. Cl.
*B65H 16/02* (2006.01)
*B65H 16/00* (2006.01)
*B65H 19/10* (2006.01)

(52) U.S. Cl.
CPC ..... *B65H 16/021* (2013.01); *B65H 16/005* (2013.01); *B65H 19/10* (2013.01)

(58) Field of Classification Search
CPC .... A47K 2010/3233; A47K 2010/3253; A47K 2010/3246; A47K 10/3687; A47K 10/38; A47K 10/3836; A47K 10/3643; A47K 10/3818; B65H 19/10; B65H 16/005; B65H 2301/413243; B65H 19/123; B65H 2402/443; B65H 2402/441;
(Continued)

(56) References Cited

U.S. PATENT DOCUMENTS 2,487,763 A * 11/1949 Patterson ..... A47K 10/22 242/598.6
2,993,658 A * 7/1961 Sweeney ..... A47K 10/38 242/560.3

(Continued)

FOREIGN PATENT DOCUMENTS

EP 332391 A1 * 9/1989
WO 2015038935 A1 3/2015
WO 2016022949 A1 2/2016

*Primary Examiner* — William A. Rivera
(74) *Attorney, Agent, or Firm* — Marshall, Gerstein & Borun LLP

(57) ABSTRACT

A web material dispenser for housing two or more rolls is provided. The web material dispenser includes a housing having a fixed housing portion provided with a first roll support assembly coupled thereto for supporting a first roll of web material. The housing further has a movable housing portion, movable between a closed position and an open position, provided with a second roll support assembly coupled thereto for supporting a second roll of web material. The fixed and movable housing portions defining a housing chamber therebetween when the movable portion is in the closed position, for at least partially enclosing the two or more rolls of web material within the housing chamber. The movable portion is moved to the open position for providing access to the two or more rolls and allowing replacement of at least one of the first and second rolls.

18 Claims, 5 Drawing Sheets

(58) Field of Classification Search
CPC ..... B65H 2402/41; B65H 2701/18484; B65H 16/021; Y10S 242/905
USPC .... 242/560, 560.2, 560.3, 594, 594.3, 594.5
See application file for complete search history.

(56) References Cited

U.S. PATENT DOCUMENTS 3,058,682 A * 10/1962 Beach ..... A47K 10/36 242/560.3
3,418,029 A * 12/1968 Wooster ..... A47K 10/38 312/34.8
D254,412 S * 3/1980 Knight ..... D6/523
4,444,359 A * 4/1984 Butler ..... A47K 10/38 225/51
4,998,681 A * 3/1991 McNeill ..... A47K 10/3836 242/560.2
5,314,131 A * 5/1994 McCanless ..... A47K 10/3836 242/559
5,628,474 A 5/1997 Krueger et al.
5,749,538 A 5/1998 Brown et al.
6,036,134 A 3/2000 Moody
6,382,553 B1 5/2002 Lewis et al.
7,083,138 B2 8/2006 Elliott et al.
7,374,128 B2 5/2008 Hendrix
7,841,556 B2 11/2010 Elliott et al.
7,861,964 B2 1/2011 Cittadino et al.
7,866,593 B2 1/2011 Fiensen et al.
7,878,444 B2 2/2011 Friensen et al.
7,913,945 B2 3/2011 Friensen et al.
7,967,235 B2 6/2011 Formon et al.
8,511,600 B2 8/2013 Formon et al.
9,138,110 B2 9/2015 Knight et al.
9,149,162 B2 * 10/2015 Dick ..... A47K 10/3612
9,635,986 B2 5/2017 Phelps
9,648,995 B2 5/2017 Eliott et al.
10,561,283 B2 * 2/2020 Deng ..... A47K 10/3836
D886,488 S * 6/2020 Orban ..... D6/520
2012/0175455 A1 * 7/2012 Denis ..... A47K 10/3818 242/594
2016/0037979 A1 2/2016 Mattheeusen et al.
2018/0073184 A1 * 3/2018 Ayers ..... D06F 39/02

* cited by examiner

WEB MATERIAL DISPENSER

CROSS-REFERENCE TO RELATED APPLICATIONS

This application claims the benefit of the filing date, under 35 USC § 119(e), of U.S. Provisional Application No. 62/748,718, filed Oct. 22, 2018, entitled "WEB MATERIAL DISPENSER", the entirety of which is hereby incorporated by reference.

TECHNICAL FIELD

The present disclosure generally relates to a web material dispenser for housing two or more rolls, and more particularly to a web material dispenser in which a first roll is supported by a fixed housing portion, and a second roll is supported by a movable housing portion. A method of replacing rolls in such dispensers is also provided.

BACKGROUND

There exist various types of dispensers, for dispensing web material from one or more rolls. Dispensers provided with two or more rolls allow reducing the likelihood that all rolls be depleted at the same time, providing janitors and maintenance personnel more time to replace an empty roll since at least an additional roll remains available in the dispenser. It is also known that web material dispensers are often provided in locations where space is limited, such as toilet cabinets for example. Replacing rolls can become unpractical when the size of dispensers is increased to receive two or more rolls, while the space available to open the dispenser and replace the roll(s) remains limited.

There is a need to provide web material dispensers which facilitate roll replacement.

SUMMARY

According to a first aspect, a web material dispenser for housing two or more rolls is provided. The dispenser comprises a housing with a fixed housing portion, and movable housing portion. The fixed housing portion has a first roll support assembly coupled thereto for supporting a first roll of web material, and the movable housing portion, which is movable between a closed position and an open position, has a second roll support assembly coupled thereto for supporting a second roll of web material. The fixed and movable housing portions define a housing chamber therebetween when the movable portion is in the closed position, for at least partially enclosing the two or more rolls of web material within the housing chamber. In the open position, access is provided to the two or more rolls for allowing replacement thereof.

According to a possible embodiment, the movable housing portion is pivotally connected to the fixed housing portion.

According to a possible embodiment, the movable housing portion includes a front cover, and the fixed housing portion includes a back wall, wherein a bottom edge of the front cover is hingedly connected to a bottom edge of the back wall.

According to a possible embodiment, the first roll support assembly includes a first support member extending from the back wall, and a first mandrel extending from the first support member for supporting the first roll of web material.

According to a possible embodiment, the first mandrel is substantially parallel to the back wall.

According to a possible embodiment, the second roll support assembly includes a second support member extending from the front cover, and a second mandrel extending from the second support member for supporting the second roll of web material.

According to a possible embodiment, the front cover comprises right and left sides, and wherein the second support member is coupled to the front cover proximate one of said sides.

According to a possible embodiment, the first and second mandrels are substantially parallel to one another when the movable housing portion is in the closed position.

According to a possible embodiment, the first and second mandrels are axially aligned when the movable housing portion is in the closed position, and wherein the front cover is adapted to rotate downwardly away front the back wall, thus positioning the second mandrel lower than the first mandrel when in the open position.

According to a possible embodiment, the housing includes right and left sides, and wherein the first and second mandrels respectively extend toward a same side of the housing.

According to a possible embodiment, the front cover is provided with an opening, and wherein at least one of the first and second roll of web material is accessible through the opening while in the closed position.

According to a possible embodiment, the web material dispenser further includes a dampening system adapted to reduce the speed at which the movable housing portion moves from the closed position to the open position.

According to a possible embodiment, the dampening system includes a resilient element coupled between the movable housing portion and fixed housing portion.

According to a possible embodiment, the resilient element is a torsional spring.

According to another aspect, a method of replacing a roll in a dispenser is also provided. The method includes the steps of:

providing access to the housing chamber of the dispenser by disengaging the movable housing portion relative to the fixed housing portion, as described above;

replacing at least one of the rolls by sliding said one roll out of a mandrel part of the first or second roll support assembly and by sliding a new roll onto the mandrel, and reengaging the movable housing portion to the fixed housing portion.

According to a possible embodiment, the movable housing portion is disengaged from the fixed housing portion by pressing a button or turning a key, causing the movable housing portion to rotate downwardly about a hinge or pivot connection, which pivotally connects the fixed and movable portions.

According to a possible embodiment, the method further includes a step of dampening motion of the movable housing portion as it rotates downwardly from the closed to the open position.

DETAILED DESCRIPTION

Figure 1:
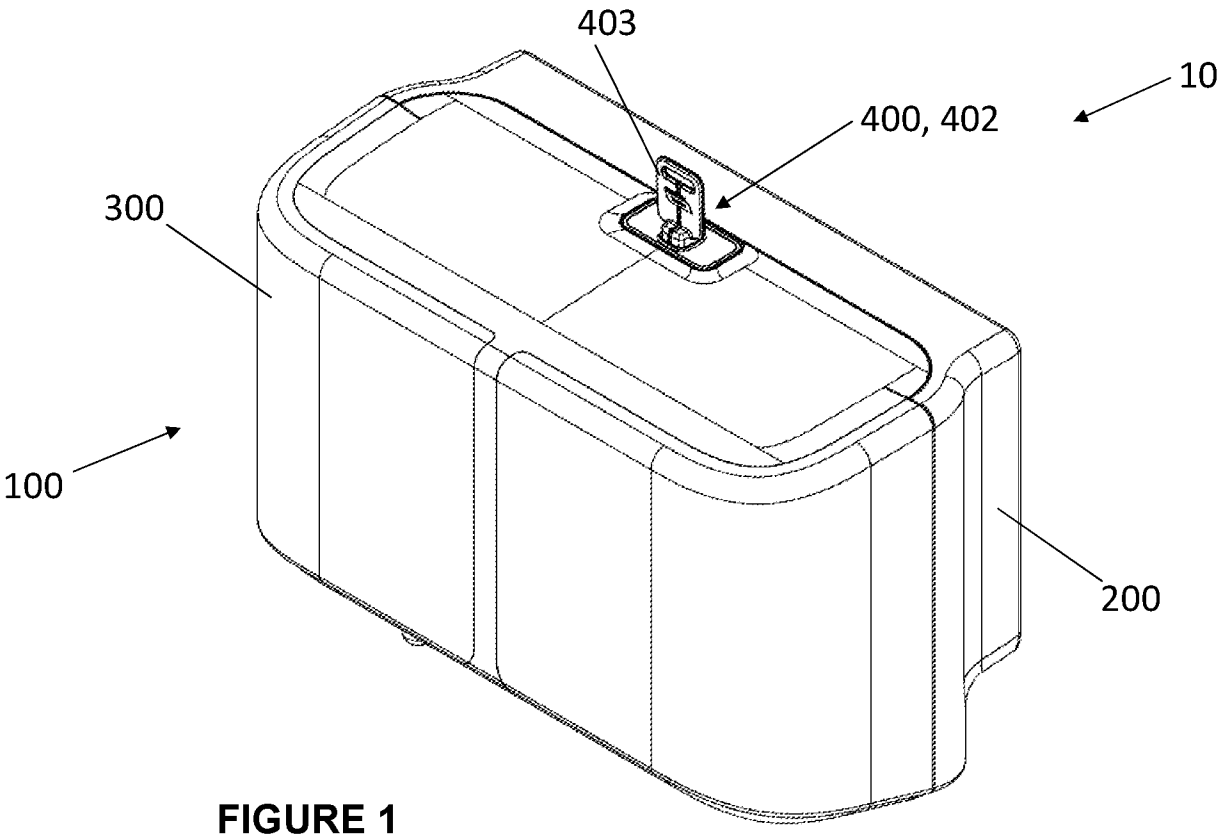
FIG. 1 is a perspective view of a web material dispenser, showing a housing in a closed configuration, according to an embodiment.

In the following description, the same numerical references refer to similar elements. Furthermore, for the sake of simplicity and clarity, namely so as to not unduly burden the figures with several reference numbers, not all figures contain references to all the components and features, and references to some components and features may be found in only one figure, and components and features of the present disclosure which are illustrated in other figures can be easily inferred therefrom. In addition, it should be noted that the embodiments, geometrical configurations, materials mentioned and/or dimensions shown in the figures are optional and are given for exemplification purposes only.

The terms "coupled", "coupling", "attached", or variants thereof as used herein can have several different meanings depending in the context in which these terms are used. For example, the terms coupled, coupling or attached can have a mechanical connotation. For example, as used herein, the terms coupled, coupling or attached can indicate that two elements or devices are directly connected to one another or connected to one another through one or more intermediate elements or devices via a mechanical element depending on the particular context.

Moreover, it will be appreciated that positional descriptions such as "above", "below", "forward", "rearward", "left", "right", and the like should, unless otherwise indicated, be taken in the context of the figures and correspond to the position and orientation of the dispenser and corresponding parts. Positional descriptions should not be considered limiting.

To provide a more concise description, some of the quantitative expressions given herein may be qualified with the term "about". It is understood that whether the term "about" is used explicitly or not, every quantity given herein is meant to refer to an actual given value, and it is also meant to refer to the approximation to such given value that would reasonably be inferred based on the ordinary skill in the art, including approximations due to the experimental and/or measurement conditions for such given value.

In the following description, an embodiment is an example or implementation of the inventions. The various appearances of "one embodiment," "an embodiment" or "some embodiments" do not necessarily all refer to the same embodiments. Although various features of the invention may be described in the context of a single embodiment, the features may also be provided separately or in any suitable combination. Conversely, although the invention may be described herein in the context of separate embodiments for clarity, the invention may also be implemented in a single embodiment. Reference in the specification to "some embodiments", "an embodiment", "one embodiment", or "other embodiments", means that a particular feature, structure, or characteristic described in connection with the embodiments is included in at least some embodiments, but not necessarily in all embodiments, of the inventions.

It is to be understood that the phraseology and terminology employed herein are not to be construed as limiting and are for descriptive purposes only. It is to be understood that the details set forth herein do not construe a limitation to an application of the invention. Furthermore, it is to be understood that the invention can be carried out or practiced in various ways and that the invention can be implemented in embodiments other than the ones outlined in the description below.

The principles and uses of the teachings of the present invention may be better understood with reference to the accompanying description, figures and examples.

It is to be understood that the terms "including", "comprising", "consisting", and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one element.

It is to be understood that where the specification states that a component, feature, structure, or characteristic "may", "might", "can", or "could" be included, that component, feature, structure, or characteristic is not required to be included.

The descriptions, examples, methods and materials presented in the claims and the specification are not to be construed as limiting but rather as illustrative only.

As will be explained below in relation to various embodiments, a web material dispenser is provided. The web material dispenser can be, for example, a paper or towel dispenser, for dispensing web material from rolls. The web material can be paper, a composition of materials including paper, or fabric. In the illustrated embodiments, the dispenser is a toilet paper dispenser, although it is appreciated that the present disclosure can encompass other types of web material dispensers. Broadly described, the web material dispenser includes a fixed housing portion, consisting in, or comprising, a back wall, and a movable housing portion, such as a front cover, movable between a closed configuration (or position) and an open configuration (or position).

The movable housing portion can be pivotally mounted to the fixed housing portion via a hinge connection, such that pivoting the movable housing portion provides access to the rolls housed in the dispenser. The web material dispenser further includes first and second roll support assemblies, each for respectively supporting a roll of web material. More specifically, the web material dispenser includes a first roll support assembly coupled to the movable housing portion and a second roll support assembly coupled to the fixed housing portion. Pivoting the front cover (i.e., opening the housing) causes the first roll support assembly, and thus the first roll of web material, to move away from the back wall, out of the housing chamber. Therefore, removal and/or replacement of one or more rolls of web material is facilitated and can be accomplished more easily, and possibly with a single hand. In addition, the dispenser can be provided with a dampening system to effectively dampen the opening motion of the movable front cover. When disengaging the front cover from the back wall, the front cover pivots downwardly under the weight of the roll support assembly. To prevent the front cover to open to abruptly, movement of the front cover is dampened by the dampening mechanism. Other features and characteristics of the web material dispenser will become apparent from the present disclosure.

Figure 2:
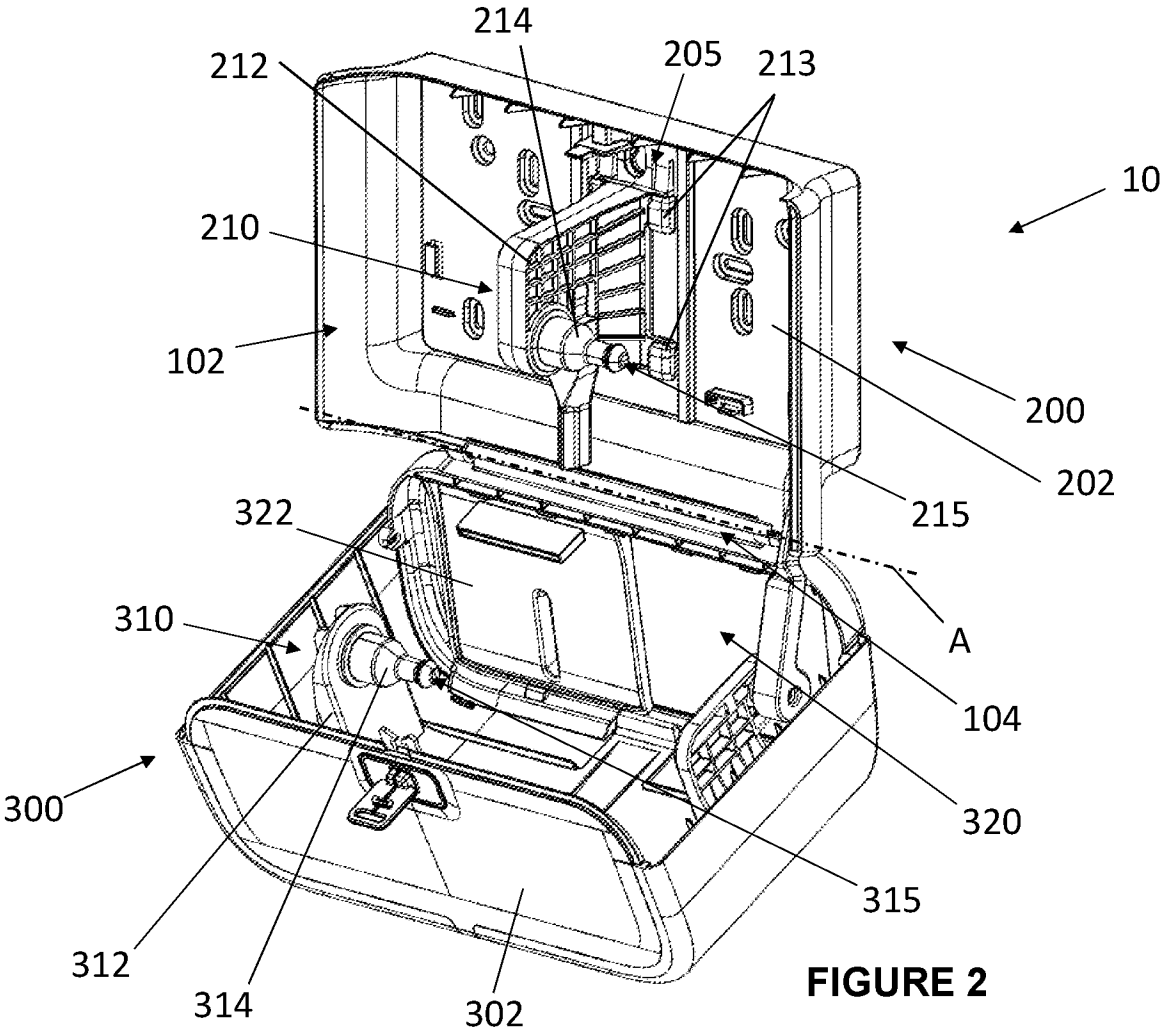
FIG. 2 is a perspective view of a web material dispenser, showing a housing in an open configuration, according to an embodiment.

Referring to FIGS. 1 and 2, a web material dispenser 10 according to a possible embodiment is shown. The web material dispenser 10 includes a housing or enclosure 100 for at least partially housing two or more rolls of web material 20 (FIG. 3), such as rolls of toilet paper for example. In the present embodiment, the housing 100 defines a housing chamber 102 (or housing interior) shaped and sized to house two rolls of web material, although it is appreciated that the housing chamber 102 can alternatively be adapted to house additional rolls. The housing 100 can include a fixed housing portion 200 and a movable housing portion 300 coupled to one another to define the housing chamber 102. In some embodiments, the movable housing portion 300 is pivotally connected to the fixed housing portion 200 and is movable between a closed position, shown in FIG. 1, and an open position, shown in FIG. 2. It is appreciated that in the closed position, the rolls of web material are at least partially enclosed within the housing chamber 102, and thus access thereto is restricted, whereas in the open configuration, the housing chamber 102 is at least partially exposed, and access to the rolls of web material is facilitated, for roll replacement.

In the illustrated embodiment, the fixed housing portion 200 includes a back wall 202 adapted to be mounted on a surface, such as a bathroom wall or stall wall (i.e., toilet stall) for example. The movable housing portion 300 is shaped and configured to be coupled, either directly or via other components, to the back wall 202. More specifically, in the present embodiment, the movable housing portion 300 consists in a front cover 302, which is pivotally connected to the back wall 202 at their respective bottom edges, although it is appreciated that other configurations are possible. It will thus be understood that the front cover 302 can pivot towards and away from the back wall 202, to move between the open and closed positions. In the illustrated embodiment, the front cover 302 is hingedly connected to the back wall 202 via a hinge 104, although other mechanisms and/or methods of connecting the front cover 302 and back wall 202 can be used. For example, a simple pivot connection could be used instead of a hinge. In the illustrated embodiment, the hinge 104 extends along an axis, or pivoting axis (A), which is substantially parallel to the lower edge of the fixed housing portion 200. In addition, in the illustrated embodiment, the front cover 302 has a substantially curved or convex shape, to allow receiving at least a portion of the rolls therein. It could also be considered to design the back wall 202 with wider lateral walls, to conceal the rolls therein, and to design the front cover 302 with a thinner, flat configuration. In this embodiment, the movable housing portion 300 comprises left and right side walls, and a bottom portion provided with at least one aperture, and a top wall. The top wall is provided with an optional locking mechanism, configured such that unlocking the mechanism allows a user to pull or disengage the movable housing portion 300 from the fixed housing portion 200, such that the front cover 202 can be pivoted or tipped downwardly about the lower edges of the fixed and movable housing portions (e.g., about the hinge 104), providing access to the rolls.

Figure 3:
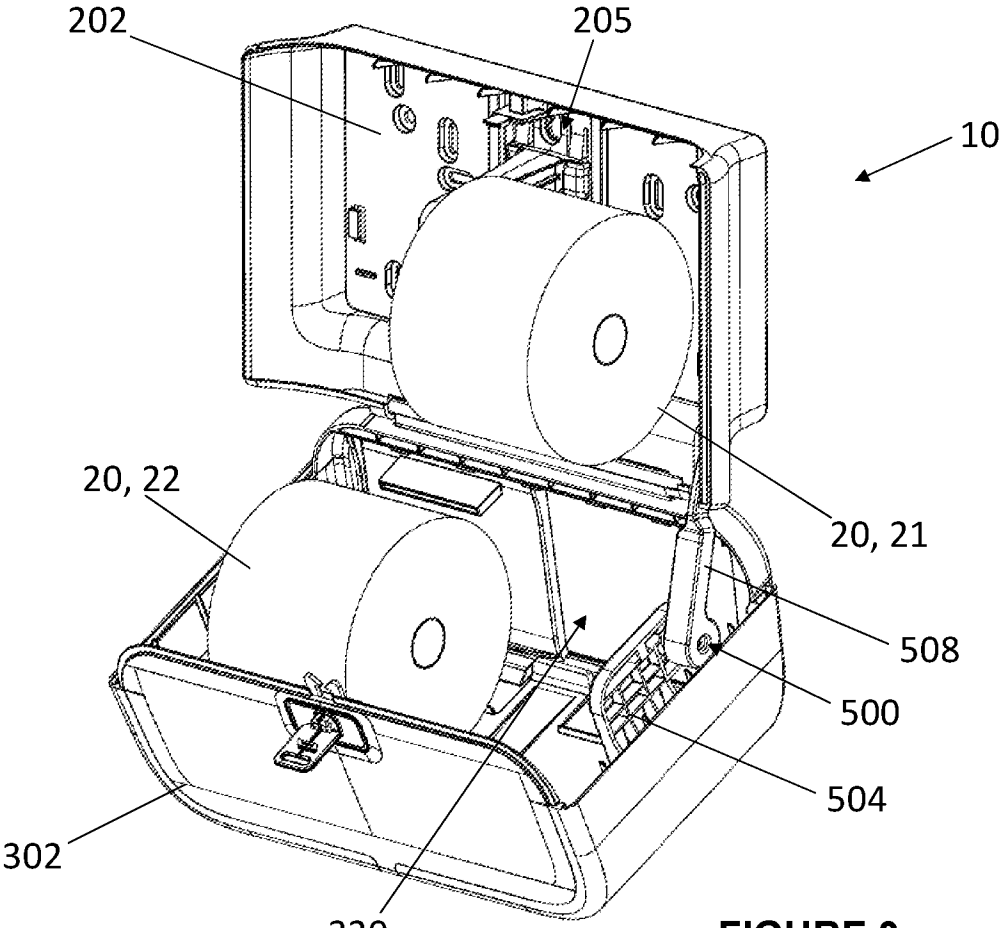
FIG. 3 is a perspective view of the web material dispenser shown in FIG. 2, showing rolls of web material mounted within the housing, according to an embodiment.

Now referring to FIGS. 2 and 3, the web material dispenser 10 includes one or more roll support assemblies adapted to respectively support a roll of web material 20 to be dispensed. In the present embodiment, the back wall 202 is provided with a first roll support assembly 210 for supporting a first roll of web material 21, and the front cover 302 is provided with a second roll support assembly 310 for supporting a second roll of web material 22. In the illustrated embodiment, the first roll support assembly 210 is coupled to the back wall 202 substantially in the middle thereof, or proximate a central portion 205, while the second roll support assembly 310 is coupled proximate a lateral side of the front cover 302. Therefore, moving the front cover 302 in the closed configuration effectively positions the first and second rolls of web material 21, 22 in a side-by-side configuration. However, it is appreciated that the roll support assemblies can be positioned at any other suitable locations. For example, the first roll support assembly 210 can be coupled to the back wall 202 proximate a lateral side thereof, and the second roll support assembly 310 can be coupled to the front cover 202 substantially in the center thereof or proximate the lateral side opposite the first roll support assembly 210.

Figure 4:
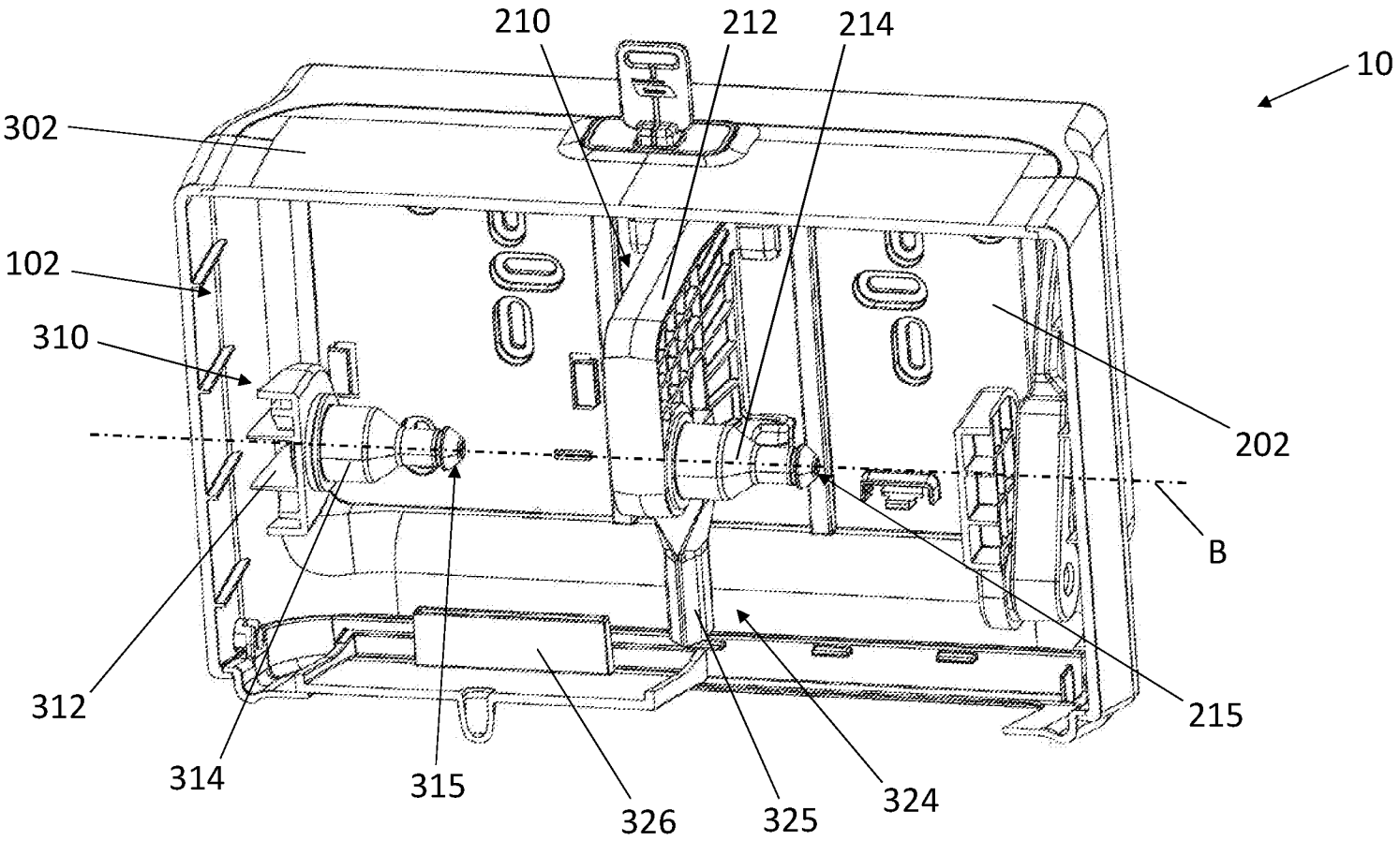
FIG. 4 is a cross-sectional view of the web material dispenser, showing the interior of the housing in the closed configuration, according to an embodiment.

As shown in FIGS. 2 and 4, the first roll support assembly 210 includes a first support member 212 extending from the back wall 202. In some embodiments, the first support member 212 can be coupled to the back wall 202, molded as a one-piece unit, or connected thereto using any other suitable means. In the present embodiment, the back wall 202 is provided with slots and/or hooks 213 to which a back portion of the first support member 212 can be connected. The first roll support assembly 210 further includes a first mandrel 214 extending from a surface of the first support member 212 for supporting the first roll of web material 21, the mandrel having a fixed inner end, and a free outer end 215. In some embodiments, the first mandrel 214 extends from the first support member 212 in a substantially perpendicular manner and is substantially parallel to the back wall 202. Therefore, it should be understood that the first support member 212 similarly extends from the back wall 202 in a substantially perpendicular manner, although it is appreciated that other configurations of the first support member 212 and/or first mandrel 214 are possible. The first mandrel 214 can be coupled to the first support member 212 using any suitable means, such as mechanical fasteners or via snap-fit connection, for example.

Similarly, in the present embodiment, the second roll support assembly 310 includes a second support member 312 extending from the front cover 302 toward the housing chamber 102. The second support member 312 can be coupled to the front cover 302 using mechanical fasteners, molded as a one-piece unit, or connected thereto using any other suitable means. The second roll support assembly 310 further includes a second mandrel 314 extending from a surface of the second support member 312 for supporting the second roll of web material 22. The second mandrel 314, similar to the first mandrel 214, also includes a fixed inner end, and a free outer end 315. In some embodiments, the second mandrel 314 extends from the second support member 312 in a substantially perpendicular manner and is also substantially parallel to the front cover 302. Therefore, it should be understood that the second support member 312 similarly extends from the front cover 302 in a substantially perpendicular manner, although it is appreciated that other configurations of the second support member 312 and/or second mandrel 314 are possible.

In the present embodiment, the second mandrel 314 can be coupled to the second support member 312 using any suitable means, such as mechanical fasteners or via snap-fit connection, for example. It should be understood that the first and second support members 212, 312 respectively extend from the back wall 202 and front cover 302 substantially perpendicularly, and therefore have surfaces being generally parallel to one another. In other words, the surfaces of the first support member 212 are generally parallel to the surfaces of the second support member 312, although other configurations are possible.

As mentioned above, when in the closed configuration, the first and second rolls of web material 21, 22 are positioned in a side-by-side configuration. Therefore, with reference to FIG. 4, it is appreciated that the first and second support members 212, 312 extend opposite one another within the housing chamber 102, with the first and second mandrels 214, 314 extending substantially parallel to each other, one on a left side of the chamber, the other one a right side of the chamber. More specifically, when in the closed configuration, the first and second mandrels 214, 314 extend from their respective support member 212, 312 along a common longitudinal axis (B). In other words, when in the closed position, the first and second mandrels 214, 314 are axially aligned (i.e., substantially coaxial, along the common longitudinal axis (B)), and can thus be at the same, or about the same distance from the back wall 202. In addition, it is appreciated that in the illustrated embodiment, the first and second mandrels 214, 314 extend towards the same side of the housing. However, it is appreciated that the mandrels 214, 314 can extend in opposite directions when the roll support assemblies 210, 310 are positioned at opposite sides of the housing 100 for example. In this illustrated embodiment, the mandrel's axes (e.g., the common longitudinal axis (B) or each respective axis of the first and second mandrels 214, 314) and the pivoting axis (A) are substantially parallel, although it is appreciated that other configurations are possible. For example, the pivoting axis (A) can be positioned along the sidewalls, and therefore be substantially perpendicular relative to the mandrel's axes and allowing the enclosure 100 to be opened laterally instead of downwardly.

In the present embodiment, moving the front cover 302 in the open configuration effectively moves the second mandrel 314 away from the back wall 202 so that the second mandrel and the roll it supports at least partially exit or move out of the housing chamber 102. More specifically, the second mandrel 314 pivots with the front cover 302 and is thus moved downwardly, away from the back wall, and lower than the first mandrel 214, as best seen in FIG. 2. In other words, when in the open position, the second mandrel 314 is positioned below and frontward of the first mandrel 214. As such, replacement of the rolls of web material is facilitated as one of the mandrels (e.g., the second mandrel 314) is moved away from the back wall 202, providing increased clearance for roll replacement.

Still referring to FIG. 4, and also to FIGS. 2 and 3, the front cover 302 is provided with an opening 320 for accessing the housing chamber 102, and more specifically for accessing web material from the first and/or second rolls 21, 22. In the present embodiment, the opening 320 is defined in a bottom section of the front cover 302 for dispensing web material from below the housing 100. In some embodiments, the front cover 302 can be further provided with a door 322 for covering a portion of the opening 320 for blocking access to at least one of the rolls of web material 20. It should thus be understood that the door 322 can be operatively mounted to the front cover 302 for moving between a first and a second position. In this example, the first position of the door 322 allows access to the first roll of web material 21 and prevents access to the second roll of web material 22. The door 322 can be moved into the second position to allow access to the second roll of web material 22 and prevent access to the first roll of web material 21. In the present embodiment, the door 322 is moved between the first and second positions by sliding along the opening 320.

In some embodiments, the door 322 can be provided with a blocking mechanism 324 adapted to block movement of the door 322 prior to the depletion of the accessible roll of web material 20. In other words, the blocking mechanism 324 blocks movement of the door 322 as long as the diameter of the roll of web material 20 being dispensed is above a predetermined threshold. Once below said threshold, the door 322 is permitted to move, thus allowing web material to be dispensed from the other one of the rolls of web material 20. For example, when the door 322 is in the first position, the blocking mechanism 324 prevents the door 322 from moving to the second position prior to the reduction of the diameter of the first roll of web material 21. In some embodiments, the blocking mechanism 324 includes a blocking element 325 adapted to engage the door 322 to block movement thereof.

In the illustrated embodiment, the door 322 includes a protrusion 326 extending therefrom within the housing chamber for abutting against the blocking element 325 when moving the door 322. The blocking element 325 has an elongated body with a top end operatively connected to the first support member 212, and a bottom end adapted to engage the protrusion 326 of the door 322. In the present embodiment, the top end of the blocking element 325 is pivotally connected to the first support member 212 and is adapted to pivot upon moving the door 322 between the first and second positions. More specifically, upon moving the door 322, the protrusion 326 engages the bottom end of the blocking element 325, causing the blocking element 325 to rotate, effectively raising the bottom end thereof and allowing the protrusion 326, and thus the door 322, to move along the opening 320.

However, it should be understood that rotating the blocking element 325 prior to the reduction of the diameter of the corresponding roll of web material 20 causes the blocking element 325 to abut against said roll of web material 20. As such, the rotation movement of the blocking element 325 is blocked, and movement of the door 322 is prevented. Once the diameter of the roll of web material is reduced at or below the predetermined threshold, the blocking element 325 is permitted to rotate further, therefore disengaging the protrusion 326 and allowing movement of the door 322.

Referring back to FIG. 1, the web material dispenser 10 can further include a locking mechanism 400 for retaining the front cover 302 in the closed position. For example, the locking mechanism 400 can be adapted to connect the front cover 302 to the back wall 202 at their respective top edges. In the present embodiment, the locking mechanism 400 is a lock-and-key mechanism 402, although it is appreciated that the locking mechanism 400 can be any other suitable type of locking mechanism 400, such as a simple push-button. In the illustrated example, the lock-and-key mechanism 402 includes a key 403 operable to release the front cover 302 from the back wall 202. As such, the front cover 302 can be moved from the closed position to the open position upon operation of the key 403. However, as previously mentioned, the locking mechanism 400 can include any suitable component and/or mechanism adapted to allow the front cover 302 to move upon operation thereof.

Figure 5:
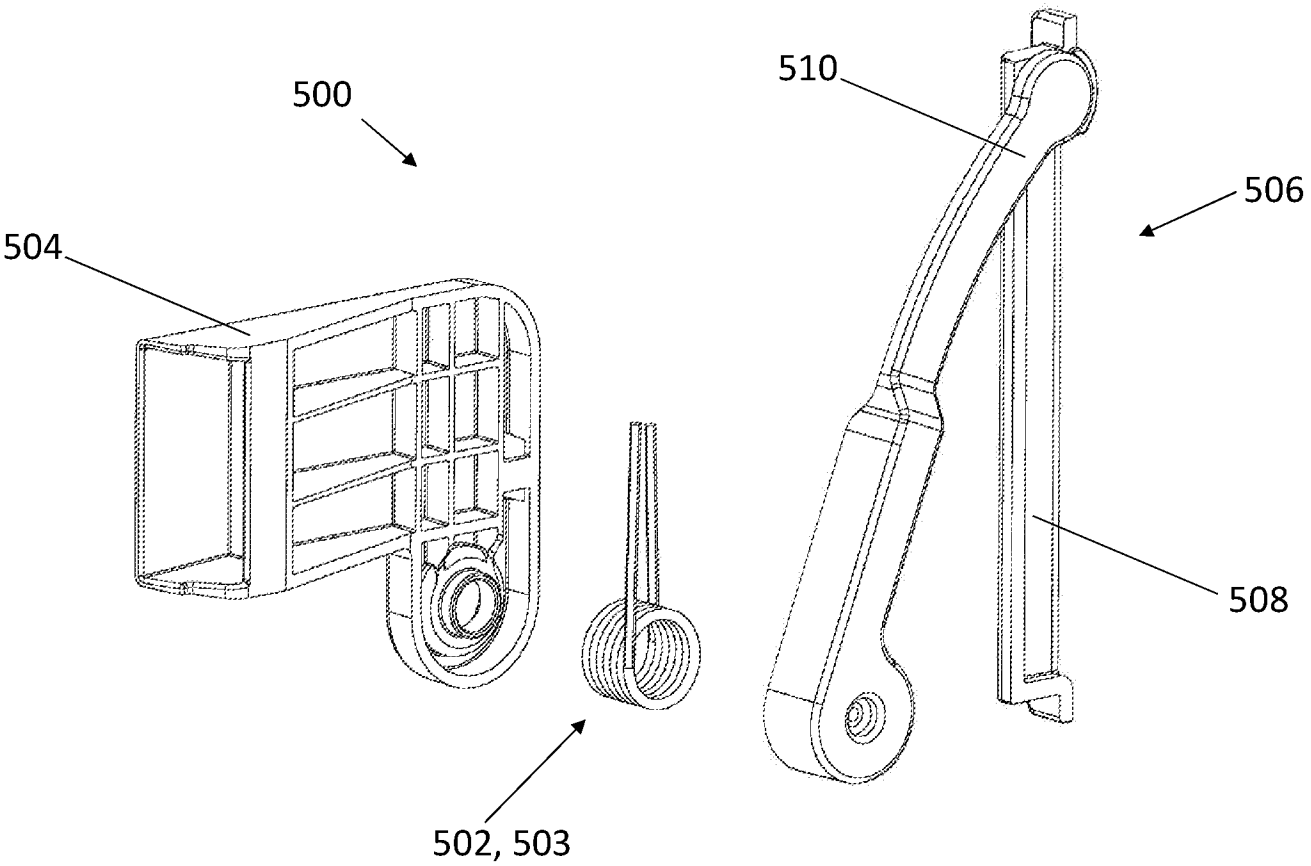
FIG. 5 is an exploded view of a dampening system according to an embodiment, showing a torsional spring coupled between components of the housing.

Now referring to FIGS. 3 and 5, the web material dispenser 10 further includes a dampening system 500 configured to dampen motion of the front cover 302 when disengaged from the back wall 202. The dampening system 500 can thus be adapted to refrain the opening rate (i.e., the speed) of the front cover 302 when moving to the open position. Upon unlocking of the locking mechanism 400, the front cover 302 rotates freely into the open position under the effect of gravity. In addition, it should be noted that the speed at which the front cover 302 opens can be increased due to the presence of the second roll support assembly 310 and second roll of web material 22, which can add some weight to the front cover 302. As such, opening the front cover 302 can cause the front cover 302 to come into contact with the surface upon which the dispenser 10 is mounted to (e.g., bathroom wall). In order to prevent such contact, the dampening system 500 can be adapted to reduce/dampen the opening speed of the front cover 302, and control the degree or angle at which the front cover 302 can open relative to the back wall 202.

In some embodiments, the dampening system 500 can include a stopper or stopping element (not shown) for dampening/absorbing the shock of the contact between the front cover 302 and the bathroom wall. The stopper can be made of shock-absorbing material, such as rubber or foam for example, although other materials are possible. The stopper can be positioned directly on the front cover 302, e.g., on either side of the opening 320, on the bathroom wall or on the back wall 202. However, it is appreciated that the stopper or stopping elements can be positioned at any other suitable location, or any combination thereof.

Still referring to FIGS. 3 and 5, the dampening system 500 can include a resilient element 502 adapted to reduce the opening speed of the front cover 302. More specifically, the resilient element 502 can be coupled to the front cover 302 for reducing the speed at which the front cover 302 opens. In the present embodiment, the resilient element 502 is a torsional spring 503 coupled between the front cover 302 and the back wall 202. The torsional spring 503 can be adapted to at least partially counter the opening movement of the front cover 302, effectively reducing the rate at which the front cover 302 opens. It is appreciated that other components/devices can be used for dampening the opening speed of the front cover 302.

In the present embodiment, the dampening system 500 can further include a cover link element 504 and a back-wall link element 506 respectively connected at opposed ends of the torsional spring 503. It is appreciated that the cover link element 504 is configured for coupling the torsional spring 503 with the front cover 302, and that the back-wall link element 506 is configured to couple the torsional spring 503 with the back wall 202. In some embodiments, the cover link element 504 is substantially fixed, while the back-wall link element 506 is displaceable to allow movement (i.e., rotation) of the front cover 302. More specifically, the back-wall link element 506 illustratively includes a guide rail 508 for connecting to the back wall 202, and a linkage arm 510 connected to the torsional spring 503 at a first end, and to the guide rail 508 at a second end 512. The second end being adapted to engage the guide rail 508 and slide along a length thereof upon opening the front cover 202.

Advantageously, various embodiments described herein provide a web material dispenser that is easy to operate to change one or both of the rolls of web material supported on the mandrels of the web material dispenser. More particularly, an operator can swap the positions of the rolls of web material supported on the mandrels with a one-handed operation. Similarly, an operator can change the roll of web material supported on any one of the mandrels of the web material dispenser using a one-handed operation.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative and non-limiting and it will be understood by persons skilled in the art that other variants and modifications may be made without departing from the scope of the invention as defined in the claims appended hereto.

The invention claimed is:

1. A web material dispenser for housing two or more rolls, comprising:

a housing comprising:

a fixed housing portion having a first roll support assembly coupled thereto for supporting a first roll of web material; and 1. a movable housing portion, movable between a closed position and an open position, and having a second roll support assembly coupled thereto for supporting a second roll of web material; and a dampening system operatively connected to the housing adapted to reduce the speed at which the movable housing portion moves from the closed position to the open position, the fixed and movable housing portions defining a housing chamber therebetween when the movable housing portion is in the closed position, for at least partially enclosing the two or more rolls of web material within the housing chamber, wherein moving the movable housing portion in the open position provides access to the two or more rolls within the housing chamber and allows replacement of at least one of the first and second rolls.

2. The web material dispenser according to claim 1, wherein the movable housing portion is pivotally connected to the fixed housing portion and pivots about a pivoting axis.

3. The web material dispenser according to claim 2, wherein the movable housing portion comprises a front cover, and the fixed housing portion comprises a back wall, and wherein a bottom edge of the front cover is hingedly connected to a bottom edge of the back wall.

4. The web material dispenser according to claim 3, wherein the first roll support assembly comprises a first support member extending from the back wall, and a first mandrel extending from a surface of the first support member for supporting the first roll of web material.

5. The web material dispenser according to claim 4, wherein the first mandrel is substantially parallel to the back wall.

6. The web material dispenser according to claim 4, wherein the first support member extends from a central portion of the back wall.

7. The web material dispenser according to claim 4, wherein the second roll support assembly comprises a second support member extending from the front cover, and a second mandrel extending from the second support member for supporting the second roll of web material.

8. The web material dispenser according to claim 7, wherein the front cover comprises right and left sides, and wherein the second support member is coupled to the front cover proximate one of said sides.

9. The web material dispenser according to claim 7, wherein the first and second mandrels are substantially parallel to one another.

10. The web material dispenser according to claim 7, wherein the first and second mandrels are axially aligned along a common longitudinal axis when the movable housing portion is in the closed position.

11. The web material dispenser according to claim 10, wherein the common longitudinal axis and the pivoting axis are substantially parallel to one another.

12. The web material dispenser according to claim 7, wherein the front cover is configured to rotate downwardly away front the back wall, thus positioning the second mandrel lower than the first mandrel when in the open position.

13. The web material dispenser according to claim 7, wherein the housing comprises right and left sides and the first and second mandrels are each provided with a free outer end by which one of the rolls can be inserted and removed and wherein the free outer ends of the first and second mandrels respectively extend toward a same side of the housing.

14. The web dispenser according to claim 3, wherein the front cover is provided with an opening, and wherein at least one of the first and second roll of web material is accessible through the opening while the movable housing portion is in the closed position.

15. The web material dispenser according to claim 1, wherein the dampening system comprises a resilient element coupled between the movable housing portion and fixed housing portion.

16. The web material dispenser according to claim 15, wherein the resilient element is a torsional spring.

17. A method of replacing a roll in a dispenser provided with two or more rolls, the method comprising the steps of:

providing access to a housing chamber of the dispenser by disengaging a movable housing portion relative to a fixed housing portion and causing the movable housing portion to rotate downwardly about a hinge or pivot connection, which pivotally connects the fixed and movable portions, the fixed housing portion being provided with a first roll support assembly, and the movable housing portion being provided with a second roll support assembly;

dampening motion of the movable housing portion during rotational movement of the movable housing portion from a closed position to a open position;

replacing at least one of the rolls by sliding said one roll out of a mandrel part of the first or second roll support assembly and by sliding a new roll onto the mandrel; and reengaging the movable housing portion to the fixed housing portion.

18. The method of claim 17, wherein the movable housing portion is disengaged from the fixed housing portion by pressing a button or turning a key.

* * * * *